US008580052B2

(12) United States Patent
Meyer

(10) Patent No.: US 8,580,052 B2
(45) Date of Patent: Nov. 12, 2013

(54) METHOD FOR THE HEAT TREATMENT OF CASTINGS USING AN AIR QUENCH AND SYSTEM FOR IMPLEMENTING THE METHOD

(75) Inventor: Philippe Meyer, Agnetz (FR)

(73) Assignee: Montupet S.A. (FR)

( * ) Notice: Subject to any disclaimer, the term of this patent is extended or adjusted under 35 U.S.C. 154(b) by 499 days.

(21) Appl. No.: 12/665,959

(22) PCT Filed: Jun. 19, 2008

(86) PCT No.: PCT/EP2008/057813

§ 371 (c)(1),
(2), (4) Date: Jun. 3, 2010

(87) PCT Pub. No.: WO2009/000751

PCT Pub. Date: Dec. 31, 2008

(65) Prior Publication Data

US 2010/0236669 A1 Sep. 23, 2010

(30) Foreign Application Priority Data

Jun. 22, 2007 (FR) ..... 07 55974

(51) Int. Cl.
*B22D 45/00* (2006.01)

(52) U.S. Cl.
USPC ..... 148/548; 266/44; 266/252

(58) Field of Classification Search
USPC ..... 266/44, 252; 148/545, 548
See application file for complete search history.

(56) References Cited

U.S. PATENT DOCUMENTS

| | | | | |
|---|---|---|---|---|
| 5,052,923 | A * | 10/1991 | Peter et al. | 432/205 |
| 5,624,255 | A | 4/1997 | Hisada et al. | |
| 6,451,137 | B1 * | 9/2002 | Pelissier | 148/660 |
| 7,255,829 | B1 * | 8/2007 | Peter et al. | 266/250 |

FOREIGN PATENT DOCUMENTS

| | | | |
|---|---|---|---|
| DE | 29603022 | U1 | 4/1996 |
| DE | 19858582 | A1 | 6/2000 |
| DE | 10117987 | A1 | 10/2002 |
| EP | 0422353 | A2 | 4/1991 |
| EP | 1154024 | A1 | 11/2001 |
| EP | 1469089 | A1 | 10/2004 |
| EP | 1531185 | A1 | 5/2005 |

OTHER PUBLICATIONS

International Search Report, PCT/EP2008/057813, dated Oct. 13, 2008.

* cited by examiner

*Primary Examiner* — Scott Kastler
(74) *Attorney, Agent, or Firm* — Lerner, David, Littenberg, Krumholz & Mentlik, LLP

(57) ABSTRACT

The invention relates according to a first aspect to a method for the heat treatment of a batch of castings, in which an air quench is applied to the castings of the batch that are arranged in a single layer. The invention also extends to a system for the heat treatment of a batch of castings that includes a ventilation system in order to cause a flow of cooling air, characterized in that it includes means for placing the castings of the batch in a single layer and means for bringing the single layer of castings beneath the ventilation system so as to apply an air quench to the single layer comprising the castings of the batch.

12 Claims, 10 Drawing Sheets

METHOD FOR THE HEAT TREATMENT OF CASTINGS USING AN AIR QUENCH AND SYSTEM FOR IMPLEMENTING THE METHOD

The field of the invention is that of heat treatments of castings made in an alloy based on aluminium.

The invention relates to a method for heat treatment of castings of the cylinder head type wherein air quenching of the parts is applied and a system for applying the method.

Heat treatment of aluminium alloys generally consists in a succession of operations.

A solution heat treatment (also referred to as a solutionization operation) operation at a high temperature typically between 490° C. and 545° C. is first of all performed for casting alloys containing silicon (between 5 and 9%), copper (between 0 and 3%) and magnesium (between 0 and 0.7%).

This operation is performed at the highest possible temperature in order to accelerate solutionization of the hardening elements of the alloy, and to dissolve the largest possible amount thereof, while avoiding re-melting of the alloy even locally (a said burning phenomenon). With this operation, a solid solution of hardening elements is obtained in the matrix of the alloy.

A quenching operation is then performed, intended to set the solid solution of hardening elements in the matrix, by performing rapid cooling from the solutionization temperature down to room temperature or down to the tempering temperature.

Finally, a tempering operation is performed in the form of dwelling in an oven at a moderate temperature, typically between 150 and 245° C., which causes recombination of the hardening elements of the alloy as fine precipitates distributed within the matrix of the alloy, and consequently increasing its strength.

In this sequence of operations, the quenching operation proves to be delicate.

Indeed, in order to retain the largest possible hardening potential, one skilled in the art tends to carry out this quenching in an efficient cooling medium, generally water, which proves to be satisfactory from the point of view of mechanical characteristics.

However, water quenching introduces, especially for parts with complex geometry, significant residual stresses due to the fact that during the quenching the different elements of the part cannot cool down at the same rate. This phenomenon is further enhanced by the appearance of steam in bubbles and as a film at the surface of the part during the water quenching, which perturbs heat exchanges.

These residual stresses may locally reach the cold elastic limit value of the alloy, and may be very detrimental to the strength of the part during use, especially under fatigue loading, if their sign causes them to be added to the external stresses applied to the part.

Increasing the temperature of the quenching water is a well-known technique for one skilled in the art for reducing residual stresses of complex parts. However this technique has limited effects from the point of view of reducing residual stresses, while causing a substantial reduction in properties. This reduction is all the more significant since the temperature of the water increases and approaches the boiling temperature of water.

The use of quenching additives (glycol water for example) is also a well-known technique for reducing residual stresses. However, it poses problems of disposal and treatment of quenching water, which generates additional costs.

An alternative quenching technique consists of using ambient air rather than water as a cooling medium. If air quenching is relatively easy to apply to loads of unit parts or parts of low massivity, it does not however provide satisfactory results in the case of treating loads of numerous and massive parts, for example cylinder heads for internal combustion engines, which because of their compactness and shape complexity (notably the presence of multiple internal cavities) do not provide a favorable surface for extracting calories by the air flow.

This insufficiency or air quenching is further enhanced in the case of heat treatment of parts in the usual so-called batch mode for treating a batch of castings in aluminium alloy. In this batch mode, the parts from the batch of parts to be treated are placed in baskets. Several baskets, generally made in steel, are stacked in a first layer on a base support, and then in a second layer of baskets placed over the first, or even possibly over other layers of baskets. The assembly consisting of the base support, of the successive layers of baskets and the parts contained in the baskets, forms what is called the heat treatment load, or more simply the load.

A vertical and horizontal space between the baskets is generally arranged so as to promote heat exchanges during quenching.

The load is successively introduced into the solution heat treatment oven, extracted from this oven in order to be submitted to quenching (for example immersed in water in the case of water quenching, or brought under a ventilation system fanning ambient air in the case of air quenching), and is then taken out of the quenching medium and introduced into the tempering oven, finally extracted from the latter so as to be brought back into the ambient air of the workshop at the end of the heat treatment.

This batch mode is particularly flexible, and therefore proves to be of interest for the operator. In particular, each load may be subject to a solutionizing or tempering treatment different from that of the other loads. The quenching media may themselves also be split into two, which further adds to flexibility (for example by using two quenching tanks with water at different temperatures).

This mode is also of interest from the energy point of view. As the loads are placed in ovens, the door of which is closed after their having been put into the oven, heat leaks are minimum and the whole treatment is carried out in a closed space, well isolated from the outside.

However, in the usual design of heat treatments in a batch mode, a significant portion of the energy is used for heating the steel baskets in the ovens, and then cooling the quenching water for the heat input share related to these baskets, which is of no interest for the main function of the heat treatment of aluminium parts.

The invention is directed to overcoming these drawbacks of the batch mode heat treatment of castings, notably castings in aluminium alloys, and to make it possible to guarantee high and homogeneous properties regardless of the part in the load.

For this purpose, and according to a first aspect, the invention relates to a method for heat treatment of a batch of castings, in which air quenching is applied to parts of the batch positioned in a single layer.

Certain preferred but non-limiting aspects of this method are the following:

- as, before quenching, the parts of the batch are arranged over several layers, the part layers are maneuvered in order to form the single layer consisting of the parts of the batch, and the single layer is brought under a ventilation system in order to perform the air quenching operation;

the ventilation system delivers an air flow with a flow rate greater than 1,000 $m^3$/h and per part, preferably greater than 1,700 $m^3$/h and per part;

the maneuvering of the layers of parts consists of unstacking baskets in which the parts are positioned;

as before the quenching, the baskets are stacked in a first location of a transfer carriage having several locations for basket stacks, the stacked baskets forming at said first location a stack of baskets comprising a first layer of baskets and at least one second layer of baskets; for unstacking the baskets, the baskets of the upper layer are lifted, the transfer carriage is moved forwards and the baskets of the upper layer are deposited in a second location of the transfer carriage, and so forth if there are more than two layers of baskets;

the parts are laid horizontally in the baskets and spaced out by at least 100 mm, preferably by at least 50 mm;

the baskets are separated by partitions and the parts are laid vertically in the baskets;

the partitions form an assembly of cells, the parts are arranged with one part per cell so that the space between the part and the cell is less than 60 mm, and preferably less than 30 mm;

the parts are suspended or maintained by supports in the baskets;

maneuvering the layers of parts consists of successively depositing each layer of parts on a receiving carriage adapted for receiving a single layer of parts;

the parts are deposited from a handling support in the form a multi-comb rake, each comb being capable of supporting a layer of parts, and in which, for successively depositing each layer, the operations consisting of presenting at right angles to the handling support a receiving carriage having means for supporting a layer of parts in the form of a comb including teeth spaced apart from each other, lowering the handling support so that the teeth of a comb of the handling support are introduced into the inter-teeth spaces of the receiving carriage in order to deposit a layer of parts on the receiving carriage, and of moving back up the handling support;

the method comprises before quenching a solution heat treatment operation performed in an oven loaded with the parts of the batch positioned over several layers;

the transfer time between the opening of the oven after solutionization, and the starting of the air cooling is less than 6 minutes, preferably less than 3 minutes 30 seconds;

the parts are extracted from the solutionization oven by means of said handling support;

following the quenching, the parts are maneuvered in order to reposition them over several layers, and a tempering operation is performed on the parts, carried out in an oven loaded with the parts of the batch positioned over several layers;

following quenching, the parts are maneuvered and loaded into the tempering oven by means of said handling support.

According to a second aspect, the invention relates to a system for heat treatment of a batch of castings including means for ensuring application of the method according to the first aspect of the invention, and in particular to a system comprising a ventilation system for fanning the ambient air and causing a cooling air flow, characterized in that it includes means for positioning the parts of the batch into a single layer, and means for bringing the single layer of parts under the ventilation system so as to apply air quenching to the parts of the batch positioned in a single layer.

Other aspects, objects and advantages of the present invention will become better apparent upon reading the following detailed description of preferred embodiments thereof, given as a non-limiting example, and made with reference to the appended drawings wherein:

FIGS. 1*a*-1*c* illustrate the load consisting of the base support, of the successive layers of baskets and of the castings contained in the baskets, according to a first possible embodiment of the invention;

FIGS. 2*a*-2*g* illustrate the sequence of operations of a first possible embodiment of the method according to the invention;

Figure 6A:
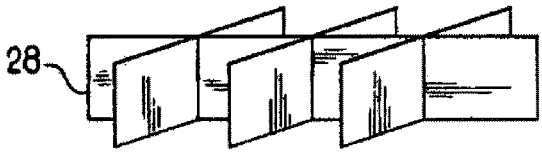
Figure 6B:
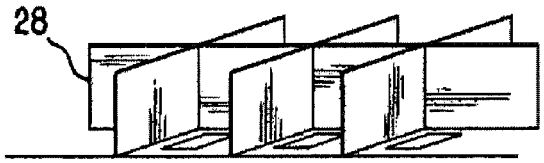
Figure 7:
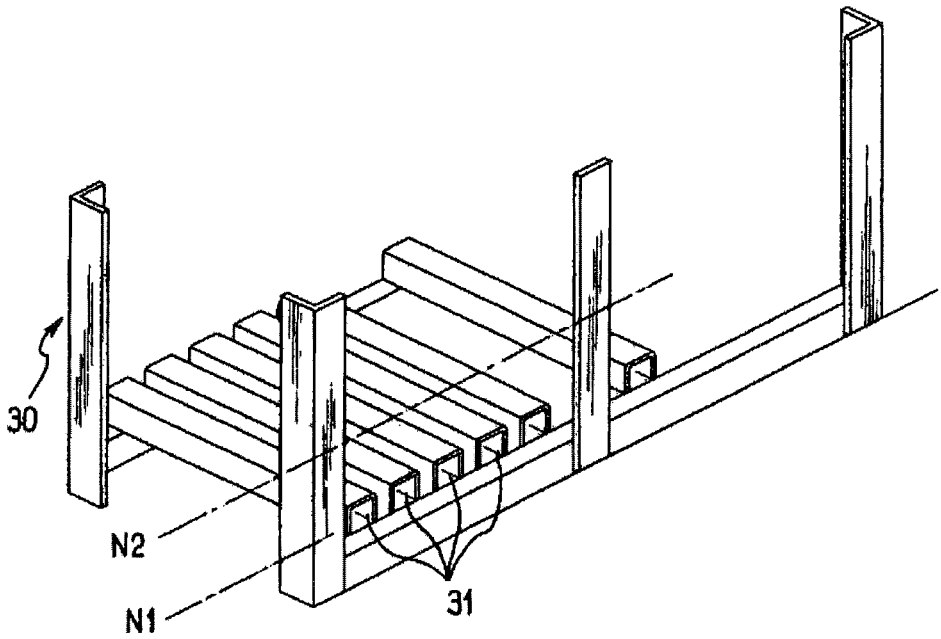
Figure 8:
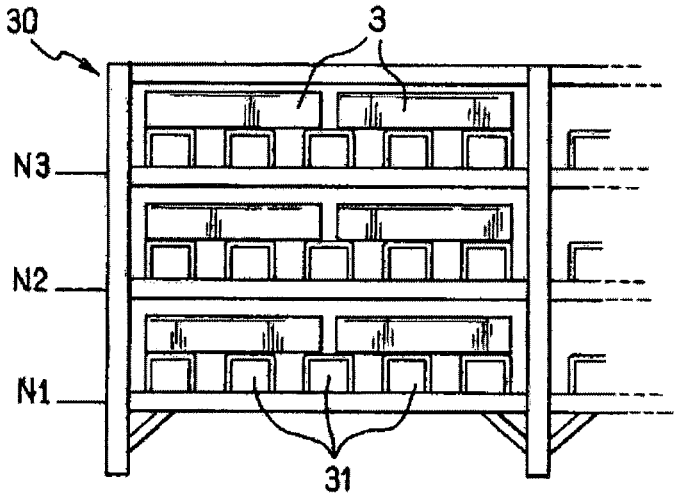
Figure 9:
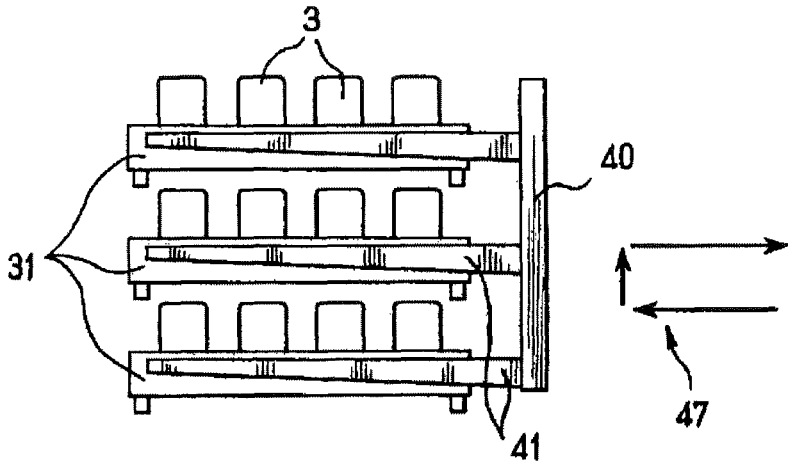
Figure 10:
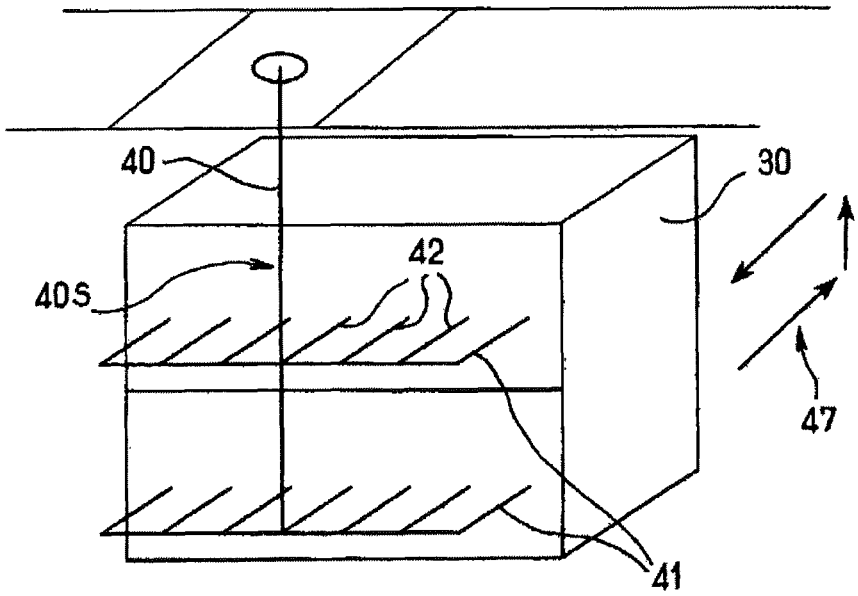
Figure 12:
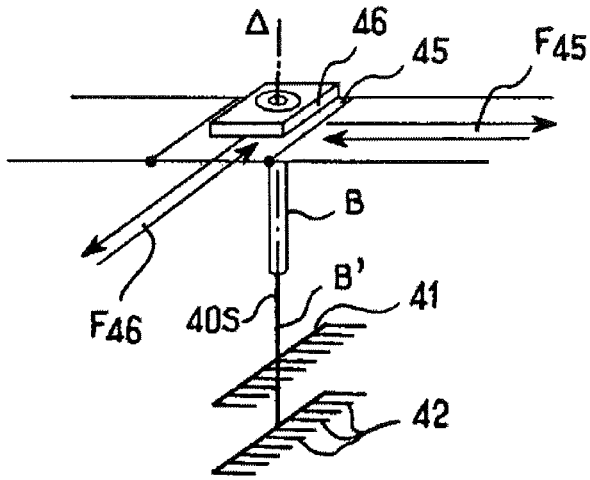
Figure 13:
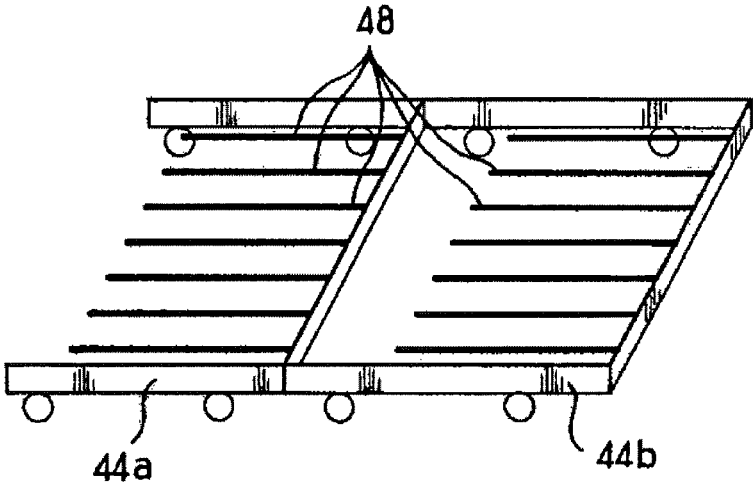

FIGS. 6*a*-6*b* are diagrams illustrating air distributors which may be used in the quenching unit;

FIGS. 7 and 8 illustrate a perspective view and a sectional view of a multilayer load support used within the scope of a second possible embodiment of the invention;

FIGS. 9 and 10 illustrate a handling support in the form of a multi-comb rake used within the scope of the second possible embodiment of the invention;

FIGS. 11*a*-11*e* are diagrams of a sequence of operations illustrating the maneuvering of the load within the scope of the second possible embodiment of the invention;

FIG. 12 illustrates the principle of a possible embodiment of the handling support of the multi-comb rake type;

FIG. 13 is a diagram illustrating the receiving carriages which may be used within the scope of the second possible embodiment of the invention.

According to a first aspect, the invention concerns a method for heat treatment of a batch of castings, in which air quenching is applied to the parts of the batch. The invention also relates to a system for heat treatment of a batch of castings including means capable of ensuring the application of the method according to the first aspect of the invention.

As this was seen earlier, the parts of a batch are generally positioned in stackable baskets, and the baskets are stacked on a base support in order to form two or more layers of baskets.

Figure 1A:
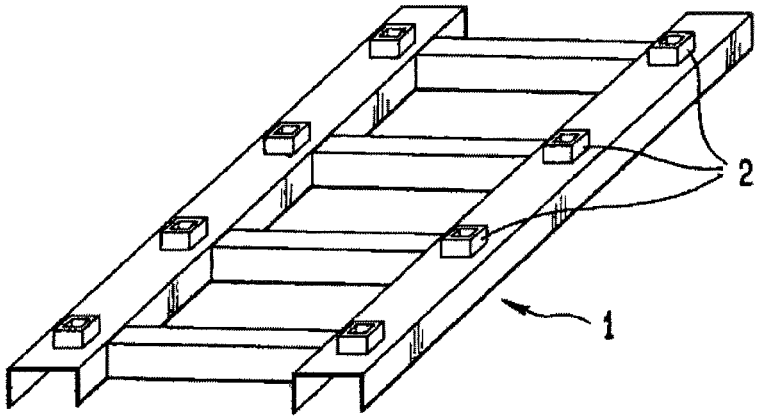

FIG. 1*a* illustrates a load support 1 conventionally used for supporting successive layers of baskets, and the parts contained in the baskets.

The load support 1 comprises housings 2 for legs of baskets and is shaped so as to be able to be driven in translation, for example by rolling on roller conveyers which make up the usual mechanization of the loads in batch ovens.

Figure 1B:
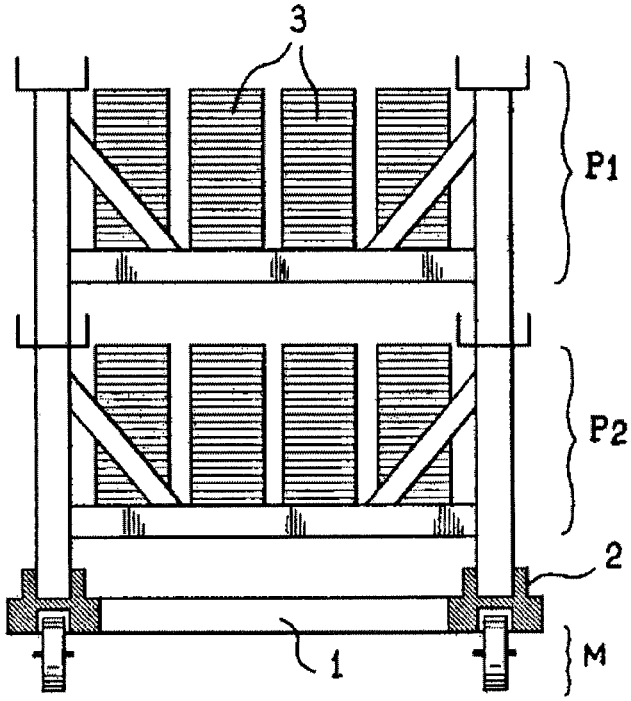

FIG. 1*b* is a transverse sectional view of the load support 1 on which two layers of baskets are stacked: an upper layer P1 of baskets (for example an upper set of two baskets) stacked on a lower layer P2 of baskets (for example a lower set of two baskets), the latter resting on the load support 1. Castings 3 are positioned in the baskets of the layers P1 and P2.

The motorization M of the heat treatment installation is also illustrated in this FIG. 1*b*. This is for example a roller track with motorized rollers.

Figure 1C:
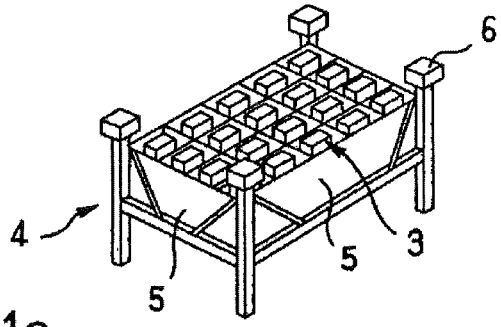

FIG. 1*c* illustrates a perspective view of a basket 4. The latter has a cellular structure and is provided with outer sheet metal walls 5. The cellular structure allows one part 3 to be positioned per cell.

The basket 4 has spaces 6 used for the female/male stacking of legs of baskets.

As this was seen earlier, the load consisting of the support 1, of the stacked baskets P1, P2 and of the parts positioned in the baskets is conventionally loaded into a conventional batch oven in order to achieve solution heat treatment, and then extracted from this oven and brought into a quenching unit in order to be subject to quenching, and then taken out of the quenching unit, loaded into a conventional batch oven in order to achieve tempering. Thus, during the heat treatment, and notably during the quenching operation, the parts of the batch are distributed over different layers.

The invention then proposes following extraction of the load from the solution heat treatment oven, to maneuver the parts in order to form a single layer of parts consisting of the parts of the batch. The single layer is then brought under a ventilation system in the quenching unit, the ventilation system fanning the ambient air in order to cause a cooling air flow. Air quenching is applied in this way to the single layer of parts.

According to a first embodiment of the invention, the conventional case of parts positioned in stackable baskets is considered. In this embodiment, the maneuvering of the parts in order to form the single layer of parts may consist of unstacking the baskets.

According to a second embodiment of the invention which will be described in more detail subsequently, a particular multilayer load support is proposed which has a plurality of means for supporting a layer of parts in the form of crossbars spaced apart from each other. In this embodiment, the maneuvering of the parts for forming a single layer of parts may consist of successively depositing each layer of parts on a receiving carriage.

The systems for maneuvering the parts which will be described subsequently in connection with the presentation of the first and second possible embodiments of the invention, are only given as non-limiting examples. One skilled in the art may in particular design alternative embodiments observing the basic principles discussed in connection with the presentation of these exemplary embodiments.

With reference to FIGS. 2*a*-2*g*, a sequence of operations according to the first possible embodiment of the method according to the invention is illustrated.

FIG. 1*a* illustrates the taking of the load consisting of the support 1, of the layers P1 and P2 of stacked baskets and of the parts positioned in the baskets. Reference 7 illustrates a transfer carriage having several locations for stacks of baskets. A first location includes a roller track 8 with motorized rollers, while a second location 9, adjacent to the first, does not have any motorized track but is equipped with housings for basket legs, similar to the housings 2 present on the support 1 (cf. FIG. 1*a*).

The carriage 7 preferably has a ventilated structure, so as to let through air.

Figure 2A:
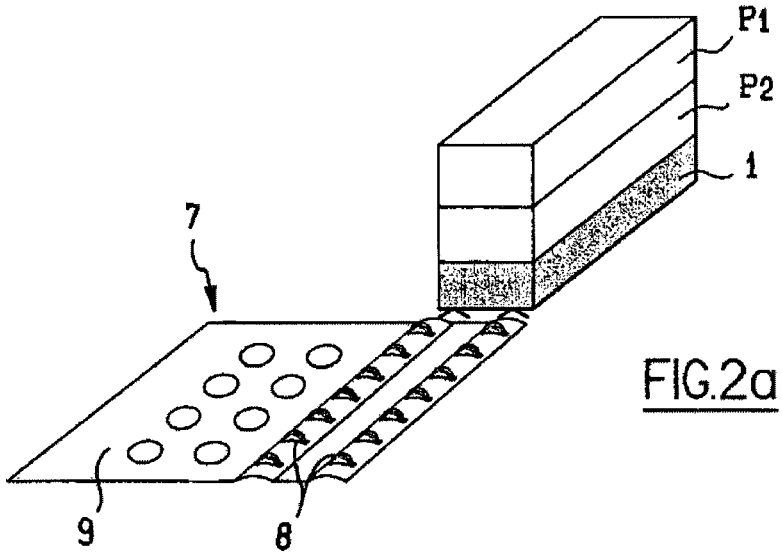
Figure 2B:
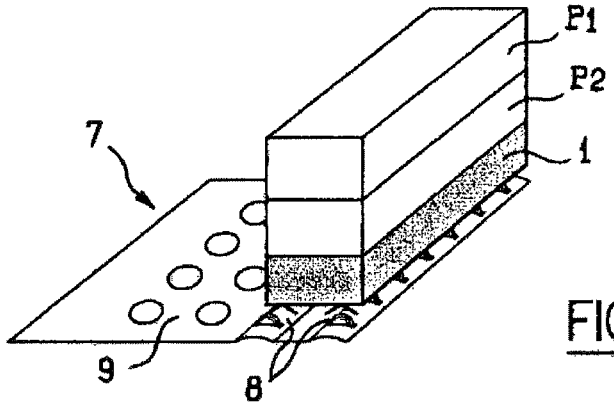

FIG. 2*b* illustrates the loading of the load on the transfer carriage. The stack of baskets P1, P2 is positioned at the first location of the carriage 7 by installing the support 1 on the track 8.

Figure 2C:
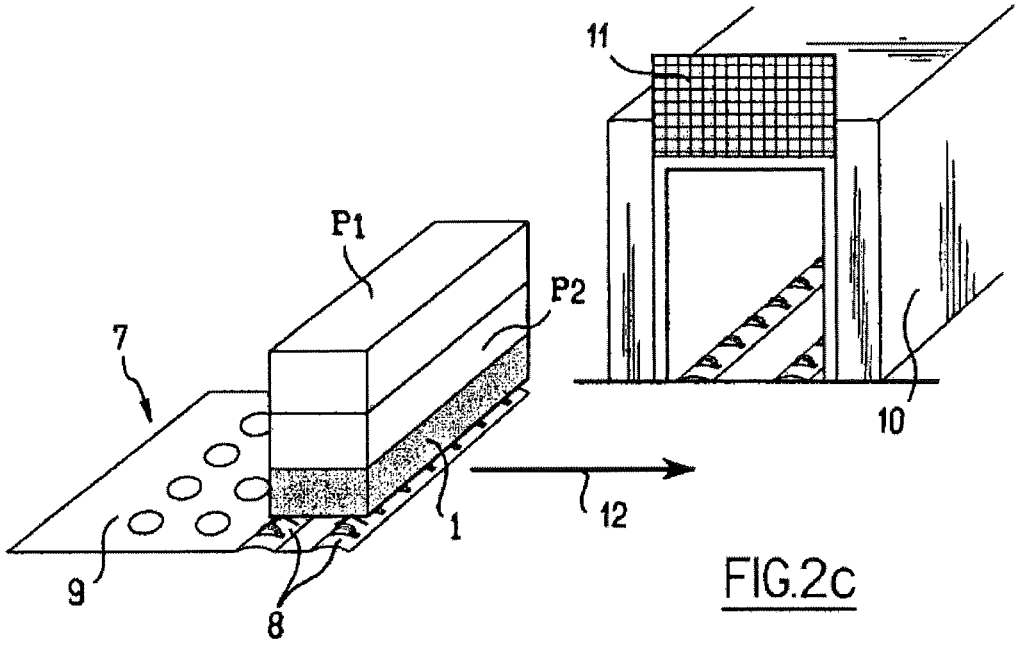

FIG. 2*c* illustrates the movement, schematized by the arrow 12, of the transfer carriage 7 towards a solutionizing oven 10.

The oven 10 is a conventional batch oven comprising an essentially closed, heat-insulated laboratory (useful working space of the oven) provided with a system for fanning air, provided with heating systems and systems for heat control from thermocouples measuring the temperature of the oven or of the air in the oven, the laboratory of the oven being accessible through a door 11 for loading or unloading the load.

Figure 2D:
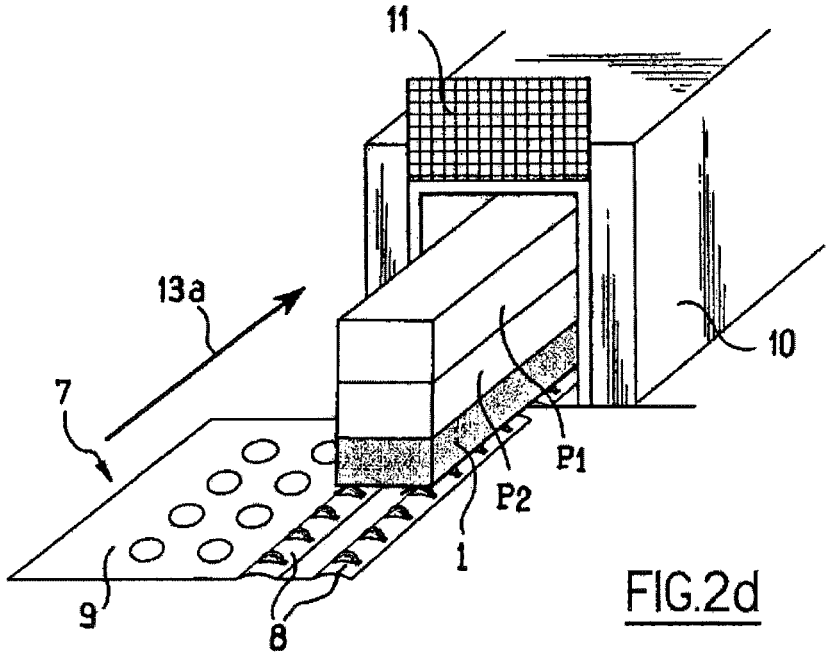

FIG. 2*d* illustrates the loading of the solution heat treatment oven 10, the load being introduced into the oven along the arrow 13*a*. Once the load is entirely loaded, the door 11 is closed and solution heat treatment is carried out.

Figure 2E:
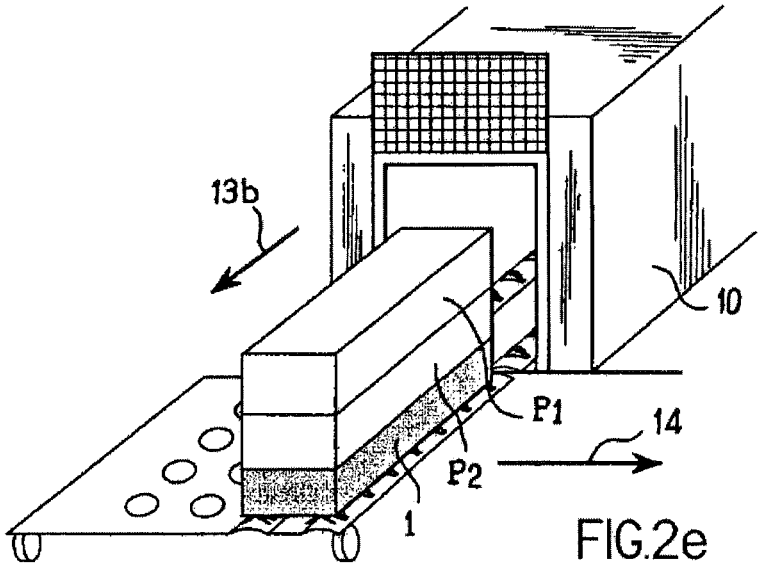

FIG. 2*e* illustrates the extraction of the load from the solutionization oven 10 (an extraction schematized by the arrow 13*b*), and the bringing of the load (schematized by the movement of the transfer carriage 7 along the arrow 14) towards an adapted system for unstacking the baskets.

Figure 2F:
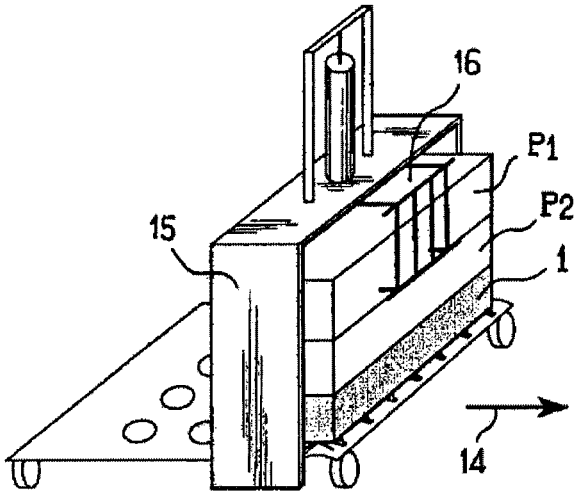

As illustrated in FIG. 2*f*, the carriage 7 is transferred so as to pass under an unstacking gantry crane 15, one embodiment of which will be described in more detail with reference to FIGS. 3 and 4, subsequently. When the first location 8 of the carriage is at right angles to the gantry crane 15, the baskets from the upper layer P1 may be lifted up with a gripping mechanism 16 integral with the gantry crane 15.

Figure 2G:
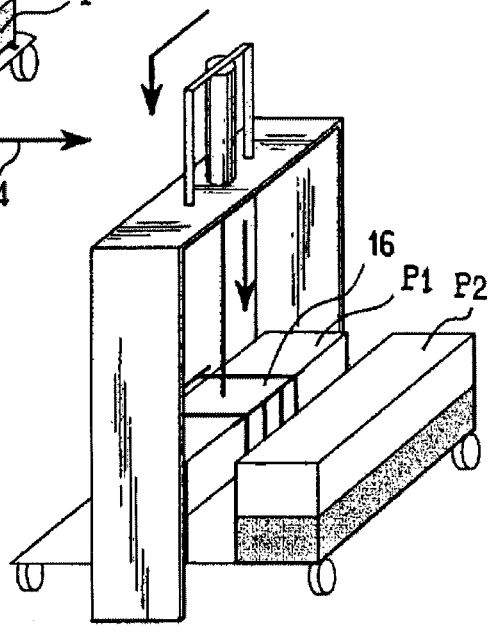

As illustrated in FIG. 2*g*, the carriage is then moved forward along the arrow 14 until the second location 9 of the carriage 7 is found at right angles to the gantry crane 15. The gripping mechanism 16 is then controlled so as to deposit the baskets of the upper layer P1 on the second location 9 of the carriage 7, which in the mean time will have advanced by the required distance so that the upper layer P1 may be presented vertically above the housings of legs 2 on the carriage 7.

The assembly of the baskets is then positioned as a single layer, the layers of baskets P1 and P2 being found positioned side by side at the same level on the carriage 7.

Figure 3:
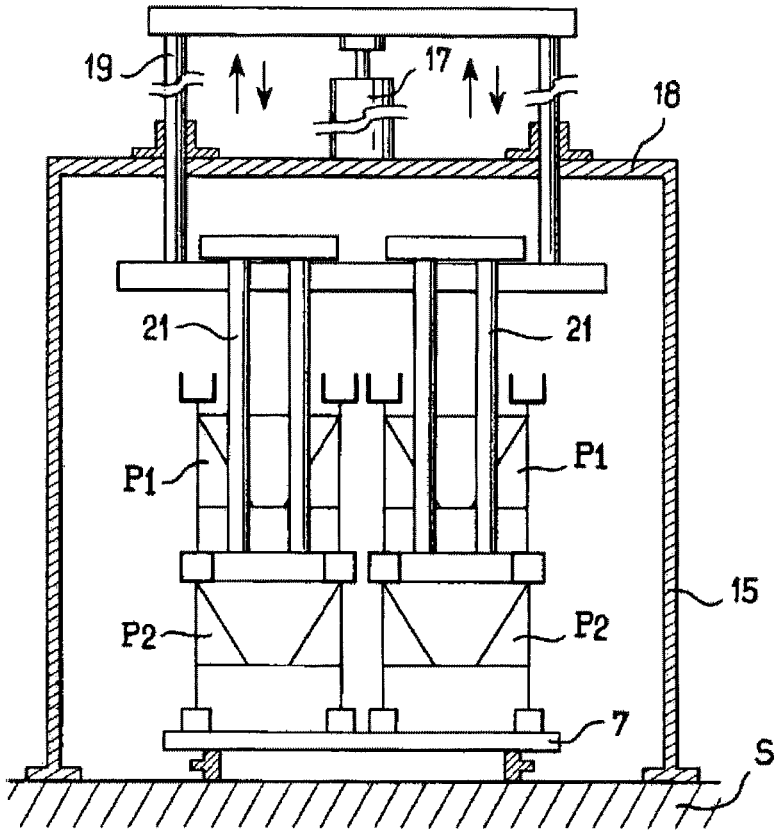
FIGS. 3 and 4 illustrate means used in a first possible embodiment of the invention for unstacking the baskets in which the parts are positioned.
Figure 4:
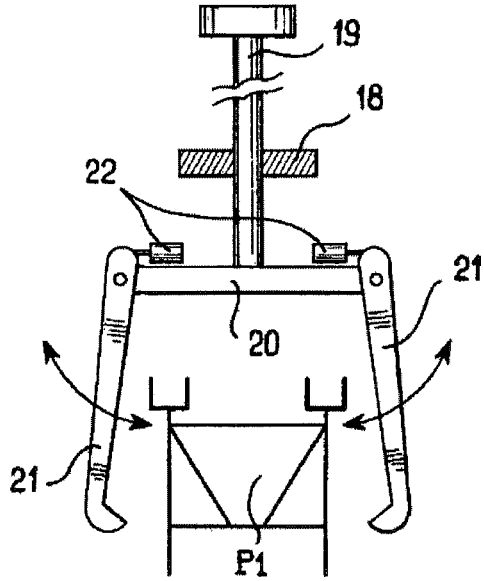

A possible embodiment of the gantry crane 15 is illustrated in FIGS. 3 and 4. The gantry crane 15 is here a structure attached to the ground 8, comprising a gripping mechanism 16 controlled via an actuator 17 in order to lift up and deposit a layer of baskets.

The gantry crane includes a crossbar 18 extending horizontally from the ground, and in which a frame 19 (for example consisting of two vertical columns, of a horizontal beam and plate) supporting the gripping mechanism 16, may vertically slide under the action of the actuator 17. The gripping mechanism 16 includes a mobile plate 20 being part of the frame 19 and is provided with claws 21 actuatable by claw actuators 22 so as to engage with the upper layer of baskets P1.

Once the unstacking of the baskets is achieved by means of the gantry crane 15, the transfer carriage 7 on which the parts are now arranged in a single layer is brought towards the ambient air quenching unit.

Figure 5:
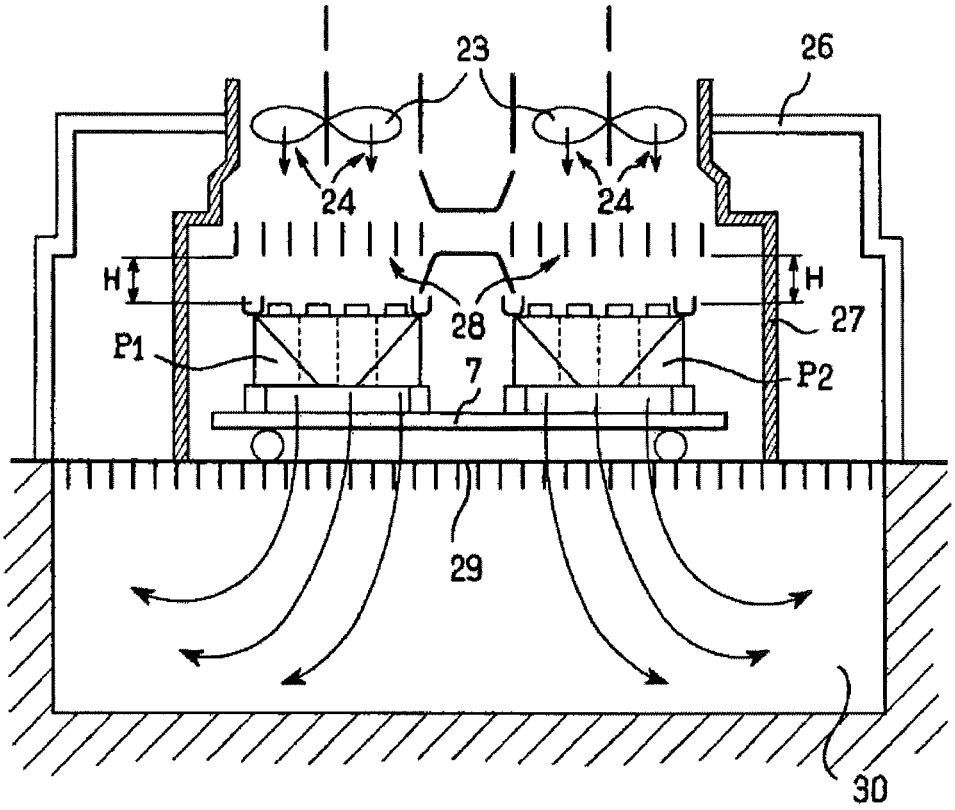
FIG. 5 is a diagram of a quenching unit used within the scope of the invention for achieving the air quenching of castings.

With reference to FIG. 5, the parts positioned in a single layer in the baskets P1 and P2 are brought at right angles to a ventilation system 23 adapted for causing a cooling air flow schematized by the arrows 24 and globally perpendicular to the single layer of parts.

In order that the mechanical properties remain at a high level, the parts are subject during the quenching to an airflow, the flow rate of which is preferably greater than 1,000 $m^3$/h and per part, and preferably even greater than 1,700 $m^3$/h and per part. As examples, the air velocity is of the order of 23 m/s for a flow rate of 1,000 $m^3$/h and per cylinder head, and of the order of 45 ms for a flow rate of 1,700 $m^3$/h and per cylinder head.

Cooling under forced air may be achieved until room temperature or the tempering temperature if a tempering is performed subsequently, is attained in the parts.

The quenching unit may essentially be closed by a wall 26 provided for recovering the air after quenching, and ensuring a sonic barrier role by discharging the air through a sound damper (the discharge conduits for air through the walls and the sound dampers are not illustrated in FIG. 5).

The air crosses the cells of the baskets in which the parts are positioned, as well as a grid provided with carriage rolling rails, for penetrating into a chamber 30.

During the quenching, the carriage 7 on which the single layer of parts is positioned, is found in an enclosure consisting of walls 27 allowing the air flow to be confined on the load.

Air distributors 28 are positioned above the load in order to channel the air flow towards each of the parts. An exemplary air distributor as a grid with a cellular structure is illustrated in FIG. 6*a*. Another example is illustrated in FIG. 6*b*, on which the grid has a closed lower surface provided with a slot for letting through air in each of the cells.

The single layer of parts is spaced apart from the lower end of the air distributors 28 by a height H.

The quenching unit may moreover comprise an air box 25 positioned between the ventilation system 23 and the air distributors 28 for ensuring the section ratios between the ventilation system 23 and the air distributors 28.

Within the scope of this first embodiment, the parts may be laid horizontally in the baskets, which is the most satisfying solution from the point of view of cooling. The parts may also be laid vertically in the baskets, which allows an increase in the capacity of the heat treatment. It will be noted here that "horizontally" or "vertically" are understood with respect to the largest surface of the part.

Preferably, in the horizontal position, the parts are spaced apart by at least 100 mm and still preferably by at least 50 mm.

In the vertical position, the parts may be laid in baskets separated by continuous or partial partitions so as to properly maintain them close to the vertical position, these partitions thereby allowing the air flow to be channeled.

Preferably, in the vertical position, these partitions will be in steel forming a set of juxtaposed cells, each joined with its closest neighbors, into which the parts may be introduced in an amount of one part per cell.

The space between the part and the cell, called E, is defined in the following way for each dimension of the cell, for example the length and the width. For a characterized dimension, 2×E is equal to the difference between the envelope of the parts built by surrounding the part with a shape identical with the shape of the cell and the actual size of the cell.

Preferably, the shape of the cell is selected so that in all dimensions, E is approximately identical to within a few mm, i.e. by adapting the shape of the basket to the part to be treated.

E defined in this way will preferably be less than 60 mm and preferably still less than 30 mm, its smallest dimension should be adjusted on a case by case basis, depending on the actual geometry of the part in order to be able to maintain the air flow rates indicated earlier. Thus it is possible to have a value of E close to zero, i.e. simply the space required for loading the part in the cell, if, because of its intrinsic geometry, the part leaves the required passage for air.

The parts may also be suspended or maintained by supports in the basket. In this case, the cell described earlier is not necessarily materialized, but the same preferences for the values of E described above will be kept with respect to the space allocated to each part (the equivalent of the cell).

The method according to the invention may in addition to air quenching applied to the single layer, also be extended to performing the solutionization operation prior to quenching and/or to performing of the tempering operation after quenching.

In such scenarios, solutionization and tempering are carried out by introducing into the corresponding solutionization and tempering ovens, loads consisting of baskets stacked over each other so as to better use the capacity of the conventional batch oven. In other words, solutionization and tempering are conventionally performed by loading the batch of parts distributed in several layers of parts into the oven.

Following solutionization, the unstacking of the baskets is therefore achieved as described earlier, and the single layer of parts is brought into the quenching unit.

The transfer time between the solutionization oven (time counted from the opening of the door) and the starting of the air cooling should not exceed 6 minutes, and preferably be located below 3 minutes 30 seconds. The Applicant surprisingly observed that in spite of rather long transfer times, required for allowing the load-unstacking operations on large ovens, the mechanical properties of the parts remained high, under these conditions, practically without any reduction in properties relatively to immediate quenching after exiting an oven.

In the case when a tempering (structural hardening) operation is performed after quenching, the baskets will preferably be re-stacked in order to reform the load. The gantry crane 15 described earlier may also be used for this purpose.

According to a second embodiment of the invention, shown with reference to FIGS. 7-12, the use of a particular multilayer load support is proposed which has a plurality of means, superposed onto each other, for supporting a layer of parts. Each of the means for supporting a layer of parts includes crossbars spaced apart from each other.

As a general rule for loads of cylinder heads, the weight of the baskets and supports in steel is of the order of 0.5 tons for 1 ton of actually treated aluminium. This second embodiment proves to be advantageous in that it only allows heating and cooling of the parts, which represents substantial energy consumption savings.

This multilayer load support 30 is illustrated in FIGS. 7 and 8. In these figures, references N1, N2 and N3 illustrate the different levels on which the layers of parts are superposed. The multilayer support 30 has a plurality of means, superposed on each other, for supporting a layer of parts in the form of crossbars 31 spaced apart from each other.

In FIG. 7, only level N1 is illustrated for the sake of clarity, while in FIG. 8, three levels are illustrated, a layer of parts 3 being positioned on each level N1-N3.

A support 40S for handling parts in the form of a multicomb rake is illustrated in FIGS. 9 and 10. This support has an arm 40 from which extend a plurality of combs 41, each comb being able to support a layer of parts. The combs 41 and the crossbars 31 are conformed in such a way that the teeth of a comb may be introduced into the space between crossbars of a means for supporting a layer of parts of the multilayer load support 30.

Thus, as this is schematized by the arrows 47 in FIGS. 8 and 9, the handling support 408 may be moved forward towards the multilayer load support 30, the teeth 42 of each of the combs 41 being introduced between the crossbars 31 of each of the means for supporting a layer of parts. Next, the support 40 may be moved back upwards so that each of the combs slightly lifts a layer of parts. Finally, the support 40 may be moved away from the support 30 in order to take away the different layers of parts.

Once the layers of parts are present on the handling support 40, the parts may be transported onto a load support, similar to the multilayer support 30. It will be understood that the layers of parts may be deposited on the support 30 from the handling support 40 while introducing the teeth of the combs between the crossbars.

In particular, it is possible to deposit the parts on a multilayer support 30 capable of being introduced into a batch oven, or on a multilayer support 30 present in a batch oven. The handling support 40S may thus be used in order to load and unload a batch oven in order to perform batchwise a solutionization operation or a tempering operation of layers of parts from the batch of parts.

In particular after solutionization, the handling support 40S is used for unloading the oven so that the different layers of parts are positioned on different combs of the handling support 40S.

In this second embodiment, the parts are then maneuvered in order to form a single layer of parts on a transfer carriage consisting of two half-carriages (under the assumption that two levels of parts have to be maneuvered in order to form the single layer), and generally of the number of carriages corresponding to the number of layers of parts.

This maneuver is illustrated in the diagrams of FIGS. 11*a*-11*e*.

Figure 11A:
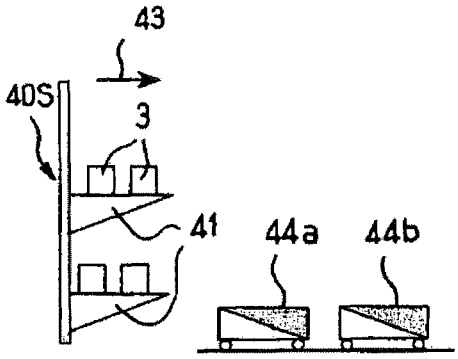
Figure 11B:
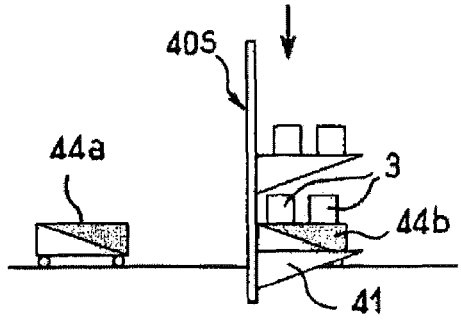

With reference to FIG. 11*a*, the handling support 40S is moved forward along the arrow 43 towards half-carriages 44*a*, 44*b* (also subsequently called receiving carriages). Each receiving carriage 44*a*, 44*b* is conformed in order to receive a layer of parts, and in particular (cf. FIG. 13) has means for supporting a layer of parts as a comb having teeth 48 spaced apart from each other.

Figure 11C:
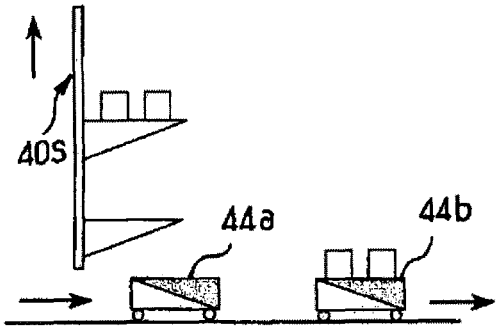

Once the handling support 40S is positioned at right angles to a first receiving carriage 44*b*, said support 40S is lowered so that the teeth of the lower comb of the support 40S penetrate into the spaces between the teeth of the supporting means of the carriage 44*b*. The parts 3 of the lower layer are then deposited on the carriage 44*b*. The teeth of the lower comb of the support 40S are then removed from the spaces between the teeth of the carriage 44*b*, and the handling support 40S is moved back upwards as this is illustrated in FIG. 11*c*.

The carriages 44*a*, 44*b* are then moved forward, for example along a motorized track and the same sequence of operations is repeated in order to deposit the layer of parts of the upper comb on the carriage 44*a*.

Figure 11D:
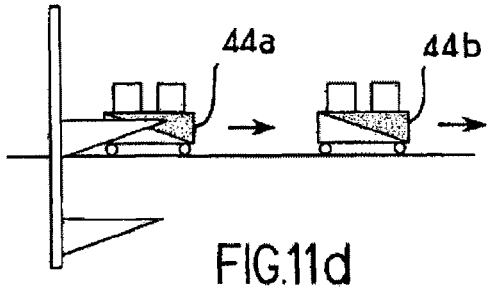
Figure 11E:
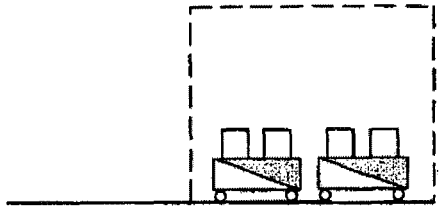

As illustrated in FIG. 11*d*, the parts 3 of the batch are then distributed over the different receiving carriages 44*a*, 44*b* into a single layer, and the carriages are then brought towards the quenching unit as described earlier in connection with the first possible embodiment of the invention, schematized in dotted lines in FIG. 11*e*.

It will be noted here that a tempering operation may be performed following quenching. The handling support 40S is then used for maneuvering the parts after quenching according to operations similar to those which have just been described and for re-forming the multilayer load before putting into the tempering batch oven.

A diagram of a possible embodiment of the handling support 40S of the multi-comb rake type used in this second possible embodiment of the invention is illustrated in FIG. 12.

The support 40S may include a first carriage 45 rolling on rails for ensuring a longitudinal movement of the support 40S in the direction indicated by the arrow $F_{45}$. It may also include a second rolling carriage 46 capable of moving laterally on the first carriage Cl in the direction indicated by the arrow $F_{46}$. The support 40S may further have an axis A allowing the rotation of a main arm B itself guiding a mobile arm B' integral with the combs.

EXAMPLES

Different exemplary applications of the invention are described hereafter. In all these examples, cylinder heads for a four in-line cylinder diesel engine were molded under static gravity in a metal mold, fire face facing downwards, with a steel sole drastically cooled so as to obtain a fine microstructure which may be characterized by the measurement of the SDAS (Secondary Dendrite Arm Spacing), with values of the order of 30 microns in the area where the tensile test specimens are taken, used for characterizing the material.

The cast metal temperature is 720° C. upon arriving in the pouring bush of the mold, from which feeding channels leave in order to fill the mold through gates located at the bottom of the part.

The yield, the ratio between the cast weight (part plus feeding system, plus feeder heads) and the weight of the parts is 1.7. The molded part weighs 14.1 kg.

All the core making is achieved in a method of the "cold box" type, for making inner shapes: admission, exhaust pipes, pipes for circulation of water, oil and for making the core containing the feeder heads, a reserve of metal located above the part itself and providing the feeding of liquid metal during solidification and contraction of the part.

The molding cycle time is of the order of 5 minutes from one part to the next.

The alloy is of the AA 356 type, a primary alloy, with a chemical composition given hereafter in weight percentages:

| Si | Fe | Mn | Mg | Ti | Zn | Al |
|---|---|---|---|---|---|---|
| 7.4 | 0.12 | 0.02 | 0.30 | 0.11 | 0.02 | balance |

The alloy has its eutectic structure changed by adding strontium.

After casting, the part is extracted from the mold and cooled in a forced air tunnel so that it is cooled down to a temperature of 50° C. within a time of the order of 120 minutes.

The cylinder heads are then submitted to usual finishing operations (removal of the filling systems, decoring, sawing off the feeder heads, deburring) and then to the following different heat treatments.

- Test no. 1: heat treatment out of the field of the invention comprising:
  - Solutionization for 6 hrs at 540° C. in a conventional oven.
  - Quenching in hot water at 70° C.
  - Tempering for 6 hrs at 200° C. in a conventional oven.
- Tests nos. 2-5: Heat treatment according to the invention comprising:
  - Solutionization for 6 hrs at 540° C. in a conventional oven.
  - Positioning of the parts vertically in baskets with wire-mesh bottom and with cells (lying on the bottom), the height of which exceeds by 150 mm the upper surface of the cylinder head.
  - Transfer of the parts from the solutionization oven towards the air cooling unit for quenching, with a handling support compliant with the one described in connection with the discussion of the second possible embodiment of the invention, within one minute 30 seconds.
  - Air quenching according to the invention, with the following critical cooling parameters:
    - The upper surface of the cells is located at 50 mm from the lower surface of the air distributor of the air box. The distance H between the parts and the lower portion of the air distribution located under the air box is therefore 200 mm.

Test no. 2

Air flow rate 1,100 $m^3$/h and part

Part space in cell: 15 mm in width and in length.

Test no. 3

Air flow rate 3,200 $m^3$/h and part

Part space in cell: 40 mm in width and in length.

Test no. 4

Air flow rate 3,200 $m^3$/h and part

Part space in cell: 15 mm in width and in length.

Test no. 5

Air flow rate 1,700 $m^3$/h and part

Part space in cell: 15 mm in width and in length.

Test no. 6: Heat treatment according to the invention comprising:

Solutionization for 6 hrs at 540° C. in a conventional oven.

Positioning of the parts vertically in baskets with a wire mesh bottom and with cells (lying on the bottom), the height of which exceeds by 150 mm the upper surface of the cylinder head.

Transfer of the parts from the solutionization oven towards the air cooling unit for quenching, with a handling support compliant with the one described in connection with the discussion of the second possible embodiment of the invention, within 3 minutes.

Air quenching according to the invention, with the following critical cooling parameters:

The upper surface of the cells is located at 50 mm from the lower surface of the air distributor of the air box. The distance H between the parts and the lower portion of the air distribution located under the air box is therefore 200 mm.

Air flow rate 3,200 $m^3$/h and part

Part space in cell: 15 mm in width and in length.

Tests no. 7: Heat treatment according to the invention comprising:

Solutionization for 6 hrs at 540° C. in a conventional oven.

Positioning of the parts horizontally in baskets with a wire mesh bottom.

Transfer of the parts from the solutionization oven towards the air cooling unit for quenching, with a handling support so as to fulfill the functions described in the alternative embodiment of the invention, within 1 minute 30 seconds.

Air quenching according to the invention, with the following critical cooling parameters:

The cylinder heads are placed with their fire face facing upwards

The distance H between the top of the cylinder heads and the base of the air distributor located under the air box is 150 mm Air flow rate 3,200 $m^3$/h and part Space between parts: about 40 mm (equivalent E=20 mm).

In all the tests nos. 2-7 according to the invention, the parts are cooled by the quenching operation down to room temperature, and then submitted to the same tempering as for test no. 1, i.e.: 6 hours at 200° C. in a conventional batch oven.

For this alloy and for all the mentioned examples, this is a heat treatment of the T7 type, i.e. with over-tempering beyond the peak of maximum hardening of the alloy.

Characterization of the Cylinder Heads

The cylinder heads were subject to room temperature characterization in traction and in hardness.

The tensile properties are measured according to the AFNOR EN 10002-1 standard in the fire face, at the level of the inter-valve bridges by tensile test specimens of diameter 6.18 mm and of calibrated length 36.2 mm. Each measurement is the average measurement of 4 test specimens per part, for 3 parts.

Brinell hardness is measured according to the AFNOR EN ISO 6506-1 and ASTM E-10-06 standards also in the fire face. One measurement is conducted per part, for five parts.

Further, thermocouples were placed in the cylinder heads, in the core of the tablature towards the fire face of the cylinder head in order to measure the cooling rate, which was characterized by the time required for bringing the cylinder head from 430° C. to 70° C.

The results are reproduced in the following table.

| Tests | Cooling rate of the cylinder head in the range from 430° C. to 70° C. | Mechanical properties of the cylinder head | | | |
|---|---|---|---|---|---|
| | | Traction | | | |
| | | Rupture stress Rm (MPa) | Elastic limit $R_{0.2}$ (MPa) | Elongation A (%) | Hardness $H_B$ |
| No. 1 Reference (water quench) | >200° C./min | 287 | 245 | 5.4 | 106 |
| No. 2 Vertical cylinder head 1,100 $m^3$/h E 15 mm H 200 mm | 21° C./min | 243 | 201 | 5.8 | 90 |
| No. 3 Vertical cylinder head 3,200 $m^3$/h E 40 mm H 200 mm | 47° C./min | — | — | — | — |
| No. 4 Vertical cylinder head 3,200 $m^3$/h E 15 mm H 200 mm | 56° C./min | 263 | 211 | 6.5 | 91 |
| No. 5 Vertical cylinder head 1,700 $m^3$/h E 15 mm H 200 mm | 34° C./min | 265 | 210 | 5.8 | 88 |
| No. 6 Vertical cylinder head 3,200 $m^3$/h E 15 mm H 200 mm Long transfer between solutionization and quenching | 56° C./min | 259 | 209 | 5.7 | 90 |
| No. 7 Horizontal cylinder head 3,200 $m^3$/h E 20 mm H 150 mm | 61° C./min | 265 | 212 | 5.7 | 88 |

The whole of these results shows that it is possible to approach the mechanical characteristics of cylinder heads quenched in water (test no. 1) with heat treatments according to the invention applying an air quench (tests nos. 2-7) applied to a single layer of parts consisting of parts of the batch.

The air quench further has the advantage of not generating residual stresses in the parts, which generally is very beneficial to the lifetime of the cylinder heads in use. This also widens the possibilities in selecting tempering, over-tempering being often imposed in order to attempt to reduce residual stresses generated during water quenching.

Further, the method according to the invention provides wide operating ranges from the point of view of the industrial operation.

For example, it is seen that for values of E of the order of 15 mm, as soon as an air flow rate of 1,700 $m^3/h$ and per part is exceeded, the mechanical characteristics of the part reach an asymptote, although the cooling rate continues to increase (tests nos. 4 and 5).

It also appears that it is desirable not to go below 1,700 $m^3/h$ and per part (see test no. 2) if the intention is to remain close to the maximum strength level accessible by these air quenching methods, which justifies the preferential flow rate ranges according to the invention.

The benefit of maintaining E at a level as small as possible is also seen (cf. tests nos. 3 and 4).

Moreover, it is possible to quench the parts horizontally or vertically.

The fact that a transfer time of 1 min 30 (i.e. the time elapsed between the opening of the door of the solutionization oven and the beginning of the forced air cooling) practically gives the same results as 3 minutes of transfer, leaves the possibility of performing, notably under good mechanical conditions of rates and accelerations, the operations for maneuvering the load in order to form the single layer of parts (tests nos. 4 and 6). This very surprising result as compared with that of usual quenching practices which impose for cast alloys very short transfer times, of the order of generally at most 15 seconds, has been subject to multiple confirmations by the Applicant. In this occasion, it was shown that beyond 6 minutes 30 seconds of transfer time, the reductions in mechanical properties become significant.

The invention claimed is:

1. A method for heat treatment of a batch of castings, comprising a solution heat treatment operation performed in an oven loaded with the parts of the batch positioned on several layers superposed onto each other, wherein, following extraction of the parts from the solution heat treatment oven, the parts are maneuvered in order to form a single layer of parts comprising the parts of the batch, the single layer of parts is brought in a quenching unit having a ventilation system in order to achieve an air quenching operation applied to the parts of the batch arranged in the single layer.

2. The method according to claim 1, wherein the ventilation system delivers an air flow rate greater than 1,000 $m^3/h$ and per part.

3. The method according to claim 1, wherein during the solution heat treatment operation the parts are arranged in baskets which are superposed onto each other, and wherein the maneuvering of the layers of parts comprises unstacking baskets in which the parts are positioned.

4. The method according to claim 2, wherein the parts are laid horizontally in the baskets and spaced apart by at least 100 mm.

5. The method according to claim 2, wherein the baskets are separated by partitions and wherein the parts are laid vertically in the baskets.

6. The method according to claim 1, wherein the partitions form a set of cells, the parts being positioned in an amount of one part per cell so that the space between the part and the cell is less than 60 mm.

7. The method according to claim 2, wherein the parts are suspended or maintained by supports in the baskets.

8. The method according to claim 1, wherein the maneuvering of the layers of parts consists of successively depositing each layer of parts on a receiving carriage adapted for receiving a single layer of parts.

9. The method according to claim 1, wherein the transfer time between the opening of the oven upon completion of the solution heat treatment operation, and the starting of the air quenching operation, is less than 6 minutes.

10. The method according to claim 1, wherein following quenching, the parts are maneuvered in order to re-position them on several layers, and an operation for tempering the parts performed in an oven loaded with the parts of the batch positioned on several layers is performed.

11. A system for heat treatment of a batch of castings comprising an oven configured so as to be loaded with the parts of the batch positioned on several layers superposed onto each other, and a quenching unit having a ventilation system in order to cause a cooling air flow, characterized in that it further includes means for extracting the parts from the oven, means for positioning the extracted parts in a single layer, and means for bringing the single layer of parts in the quenching unit so as to apply air quenching to the parts of the batch positioned in a single layer.

12. The system according to claim 11, wherein the ventilation system delivers an air flow rate greater than 1,000 $m^3/h$ and per part.

* * * * *